US005992111A

United States Patent [19]

Waterhouse

[11] Patent Number: 5,992,111

[45] Date of Patent: Nov. 30, 1999

[54] GLASS BLOCK CONSTRUCTION KIT

[75] Inventor: Dianne Waterhouse, Brantford, Canada

[73] Assignee: Round Top Window Products Inc.

[21] Appl. No.: 08/783,845

[22] Filed: Jan. 16, 1997

[51] Int. Cl.[6] ..... E04C 1/42

[52] U.S. Cl. ..... 52/308; 52/203; 52/396.09; 52/456; 52/476; 52/656.5; 52/656.7; 52/656.8

[58] Field of Search ..... 52/307, 308, 200, 52/204.5, 204.591, 204.593, 204.595, 204.6, 204.61, 203, 656.5, 656.7, 656.8, 656.9, 384, 387, 456, 476, 396.08, 396.09, 391.1

[56] References Cited

U.S. PATENT DOCUMENTS

| | | | |
|---|---|---|---|
| 4,316,352 | 2/1982 | Harrington et al. | 52/656.5 |
| 4,494,342 | 1/1985 | Decker | 52/203 |
| 4,986,048 | 1/1991 | McMarlin | 52/308 X |
| 4,999,964 | 3/1991 | Taylor | 52/477 |
| 5,003,744 | 4/1991 | Taylor | 52/308 |
| 5,010,704 | 4/1991 | Thompson | 52/308 |
| 5,031,372 | 7/1991 | McCluer | 52/307 |
| 5,042,210 | 8/1991 | Taylor | 52/307 |
| 5,218,806 | 6/1993 | Taylor | 52/410 |
| 5,430,985 | 7/1995 | Coleman | 52/308 |
| 5,448,864 | 9/1995 | Rosamond | 52/307 |
| 5,640,818 | 6/1997 | Wirkus et al. | 52/308 X |
| 5,640,819 | 6/1997 | Wirkus et al. | 52/308 |
| 5,655,345 | 8/1997 | Thompson | 52/396.1 |

FOREIGN PATENT DOCUMENTS 33 09 463 9/1984 Germany .

*Primary Examiner*—Christopher T. Kent
*Assistant Examiner*—Yvonne Horton-Richardson

[57] ABSTRACT

A glass block construction kit comprises a peripheral frame with inwardly directed lips on its opposite sides and an interior frame having an outer wall held by the lips on the peripheral frame. The peripheral frame is made from a plastic material such as vinyl and the like while the interior frame is made of a more rigid material. The interior frame also includes a plurality of frame members which form glass block pockets. Glass block retainers are mounted on both sides of each frame member. These retainers are again made of plastic, preferably the same material used in forming the peripheral frame.

10 Claims, 12 Drawing Sheets

GLASS BLOCK CONSTRUCTION KIT

FIELD OF THE INVENTION

The present invention relates to a glass block construction kit using a plastic, Preferably vinyl, exterior frame.

BACKGROUND OF THE INVENTION

Glass block panels are becoming ever more popular. They are esthetically appealing and from a functional standpoint they allow light penetration without direct visibility to provide privacy depending upon what type of glass block is used in the panel.

Known glass block panels use a grid like frame with glass blocks fitted in the pocket regions of the frame. The frame is made from metallic material such as aluminum to provide required rigidity for holding the glass blocks.

While aluminum does have the benefit of being light in weight and relatively strong its use necessitates that the glass blocks be caulked, mortared or otherwise suitably sealed in the frame. Furthermore aluminum and other metallic frames have the undesirable characteristics that they rust or otherwise deteriorate in wet and/or salty conditions and that they allow loss of heat energy because of their high thermal conductivity. Accordingly thermal breaks are often required in a conventional glass block panel.

Examples of glass block panels using metallic frames are shown in the U.S. Pat. No. 5,042,210 issued Aug. 27, 1991 to Taylor and U.S. Pat. No. 5,218,806 issued Jan. 15, 1993 to Taylor. U.S. Pat. No. 5,003,744 issued Apr. 2, 1991 to Taylor also shows a glass block panel assembly using a metallic frame with thermal breaks to reduce the loss of heat energy through the glass block panel.

In each of the glass block panels shown in the above patents mortar, bonding or caulking agents are required to seal the blocks within the panel. These panels are therefore relatively labour extensive and time consuming to assemble and are not easily put together at the actual job site. These types of glass panels, generally speaking, could not be together by most home owners who might want to do their assembly and installation. Accordingly known glass block panels would generally be preassembled by people having professional skills and carried as a relatively large and heavy item to the job site.

Polyvinyl chloride, ie, vinyl is a material that is gaining more and more acceptance in standard window manufacturing. The vinyl is used as a surrounding frame for windows using a solid window pane. Vinyl has the benefit that it is a very good heat insulator and has esthetically desirable characteristics. For example vinyl can be extruded in different permanent colours without having to paint the vinyl. Furthermore vinyl does not rust like metallic material and therefore has great application in wet conditions such as those found in a naturally damp environment and even those found in a man made wet area such as a bathroom shower and the like.

To date vinyl has not been accepted as a suitable frame material in the manufacture of glass block panels because it does not have sufficient strength for supporting a series of small glass blocks in a grid like pattern or formation. Accordingly known glass block panels have not been able to take advantage of the benefits provided by vinyl and other similar plastic materials.

SUMMARY OF THE INVENTION

The present invention provides a glass block construction kit having a two part frame with the outer part of the frame formed from a plastic such as vinyl and the inner part of the frame being made from a more rigid material such as aluminum and the like. The inner frame which is covered by the outer frame provides the required strength for holding glass blocks within the panel assembly while the outer frame reduces heat loss and provides sealing properties and other benefits as a result of its plastic construction.

More particularly a glass block construction kit according to the present invention comprises a peripheral frame of plastic material with inwardly directed lips on opposite sides of the peripheral frame. Also provided is an interior frame made from material more rigid than that of the peripheral frame. The interior frame has an outer wall held by the lips on the peripheral frame and also has a plurality of grid forming frame members bordered by the outer wall. These frame members form glass block pockets and plastic retainers are mounted on both sides of each frame member.

According to an aspect of the invention the lip on the peripheral frame on one side of the kit is removably secured to the peripheral frame for insertion and removal of the interior frame and the retainers on the same side of the kit are removably secured to the frame members for insertion and removal of the glass blocks.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figures 1, 1A:
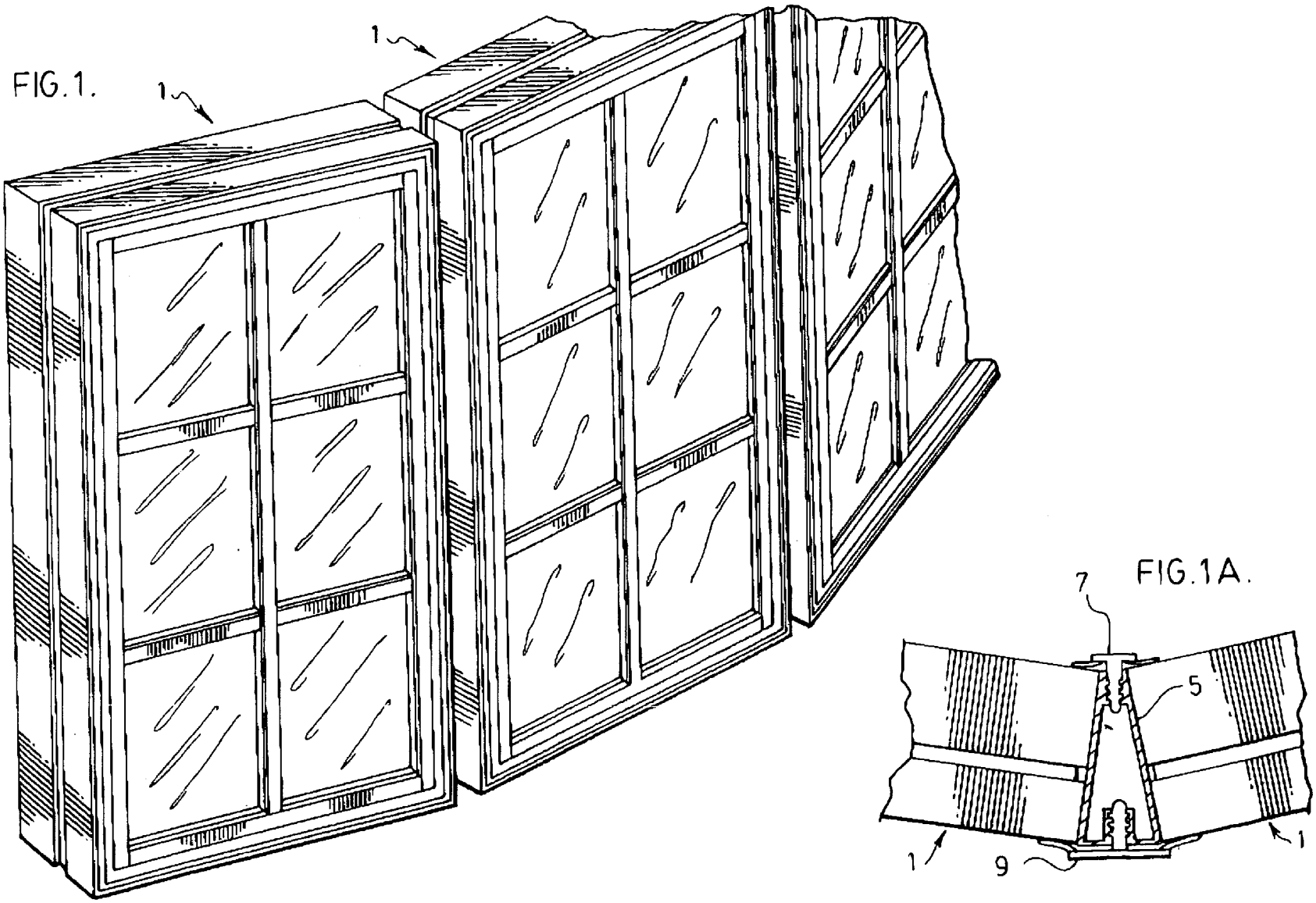
FIG. 1 is a perspective view of a plurality of interconnected glass block panels each of which is made from a construction kit according to a preferred embodiment of the present invention.
FIG. 1A is a top view of the interconnection between two of the glass block panels shown in FIG. 1.

FIG. 1 shows a plurality of glass block panels each of which is indicated generally at 1. These glass block panels have a true divided light assembly in that they are formed by a series of individual glass blocks separated by muntin bars within the panel. This is to be contrasted to a window with a single pane of glass having false dividers, ie, dividers applied simply to the surface of the glass which typically has a much less appealing appearance than that of a true divided light window.

FIG. 1A shows the connecting of the glass block panels 1 of FIG. 1 in a side by side slightly convex configuration, ie, with a bowing of the panels.

More particularly a triangular, rigid, eg aluminum, spacer 5 is provided between each of the panels 1. This spacer has notched openings at its opposite ends with first and second T members 7 and 9 respectively each having notched tongues secured within the openings of the spacer. Each of these T members includes a resilient seal and as can be seen in FIG. 1A T member 9 at the wide end of spacer 5 has a substantially longer head than the smaller T member 7 at the narrow end of the spacer. The relative sizing of the two T members 7 and 9 accommodates the variance in the spacing between the two panel members at the narrow and wider end of the spacer 5. The T members themselves act as connectors and prevent air leakage between the panels.

Figure 2:
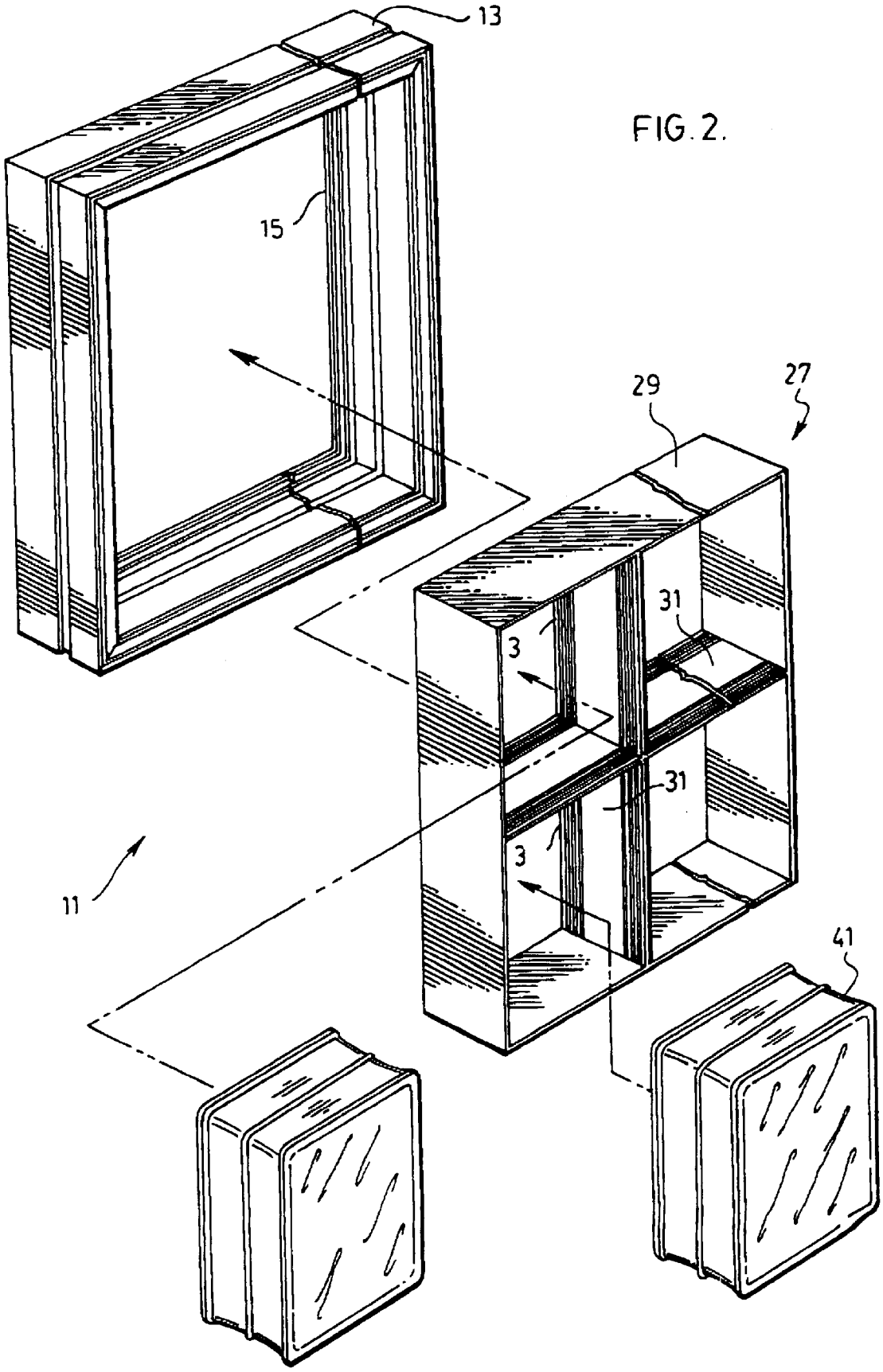
FIG. 2 is an exploded perspective view of a glass block construction kit according to a preferred embodiment of the present invention.

FIG. 2 is an exploded view of a glass block panel generally indicated at 11. This glass block panel is substantially the same as the glass block panels 1 of FIG. 1 except that it uses four glass blocks rather than the six glass blocks shown in the panel of FIG. 1.

Panel 11 uses a construction kit into which glass blocks are fitted. It is referred to as a kit because the glass block need not be put in place at the same time as the kit is put together as will be described later in detail.

The construction kit is formed by an outer or peripheral frame 13. This frame is made of a plastic material such as vinyl and the like and provides, among other things, heat insulating, weather resisting and sealing properties not found in metallic materials such as aluminum and the like.

Figure 3:
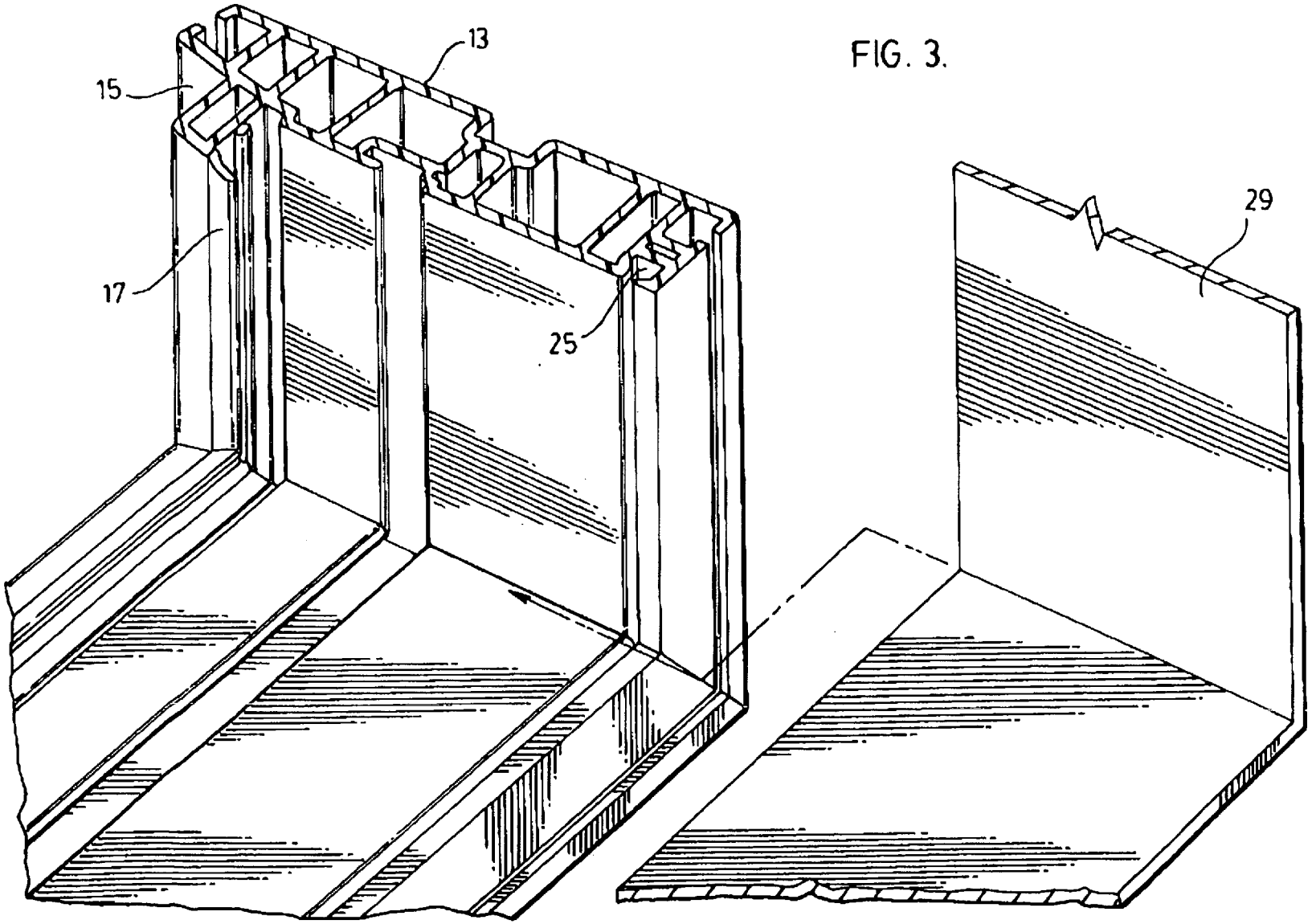
FIGS. 3 through 5A show various different steps in the assembly of the glass block construction kit of FIG. 2.
Figure 4:
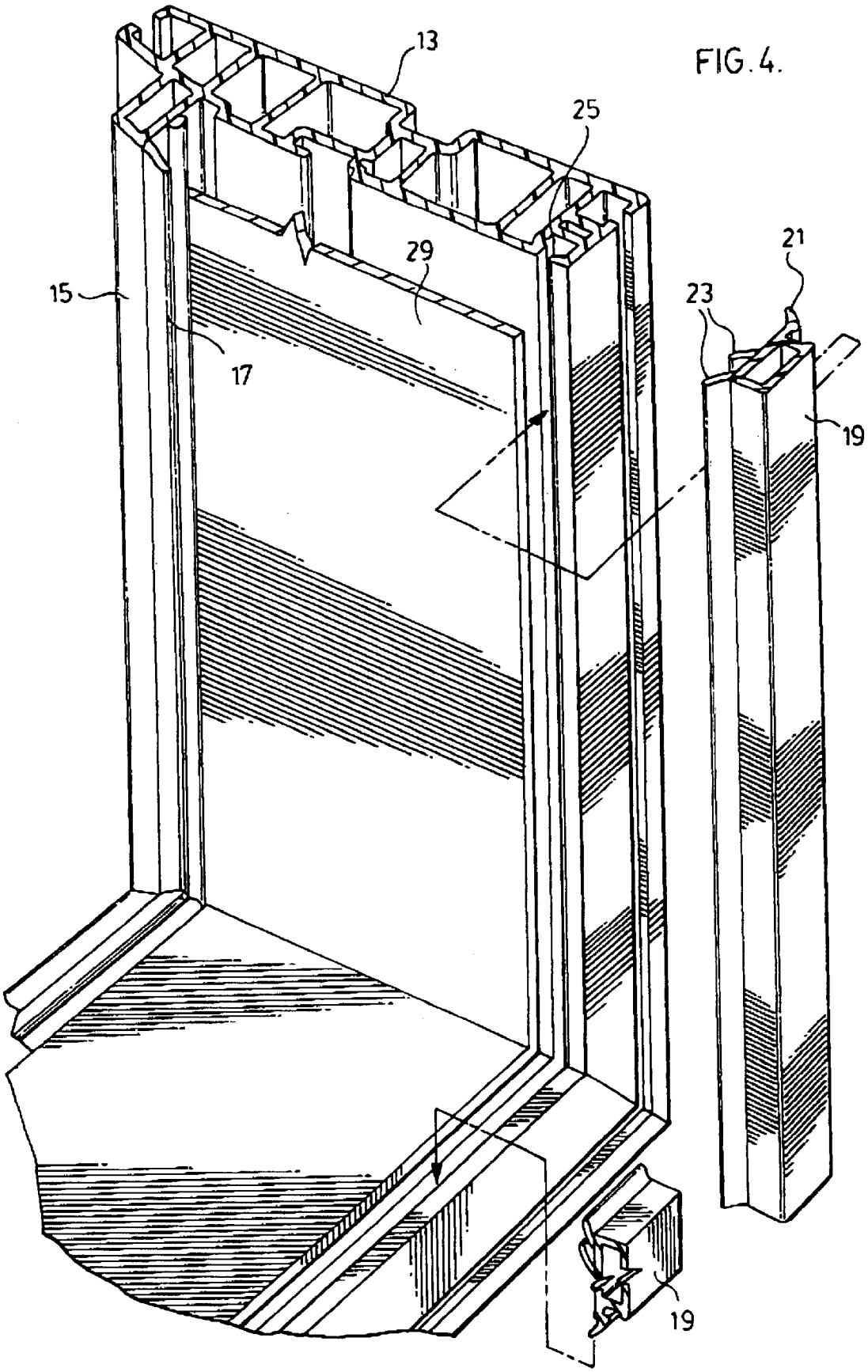

As will be better seen in FIGS. 3 and 4 of the drawings peripheral frame 13 includes a glazing bead 15 on its one side. This glazing bead is integrally formed with the frame which will be typically made in an extrusion process. Bead 15 is coextruded with a more flexible seal 17.

When the glass block panel is fully assembled and put in use the integral glazing bead 15 will be placed in an outwardly facing position, ie, to the outside of the window. The integral construction of bead 15 with the frame assists in preventing dismantling of the panel in this direction.

Provided within the peripheral frame 13 is an interior frame 27 made from a material such as aluminum which is substantially more rigid than the plastic material in the peripheral frame. Therefore the interior frame is sufficiently strong to properly support a series of glass blocks 41 in a grid like pattern. The peripheral frame 13 has sufficient strength to trap and secure the interior frame as a unitary construction.

Figure 5:
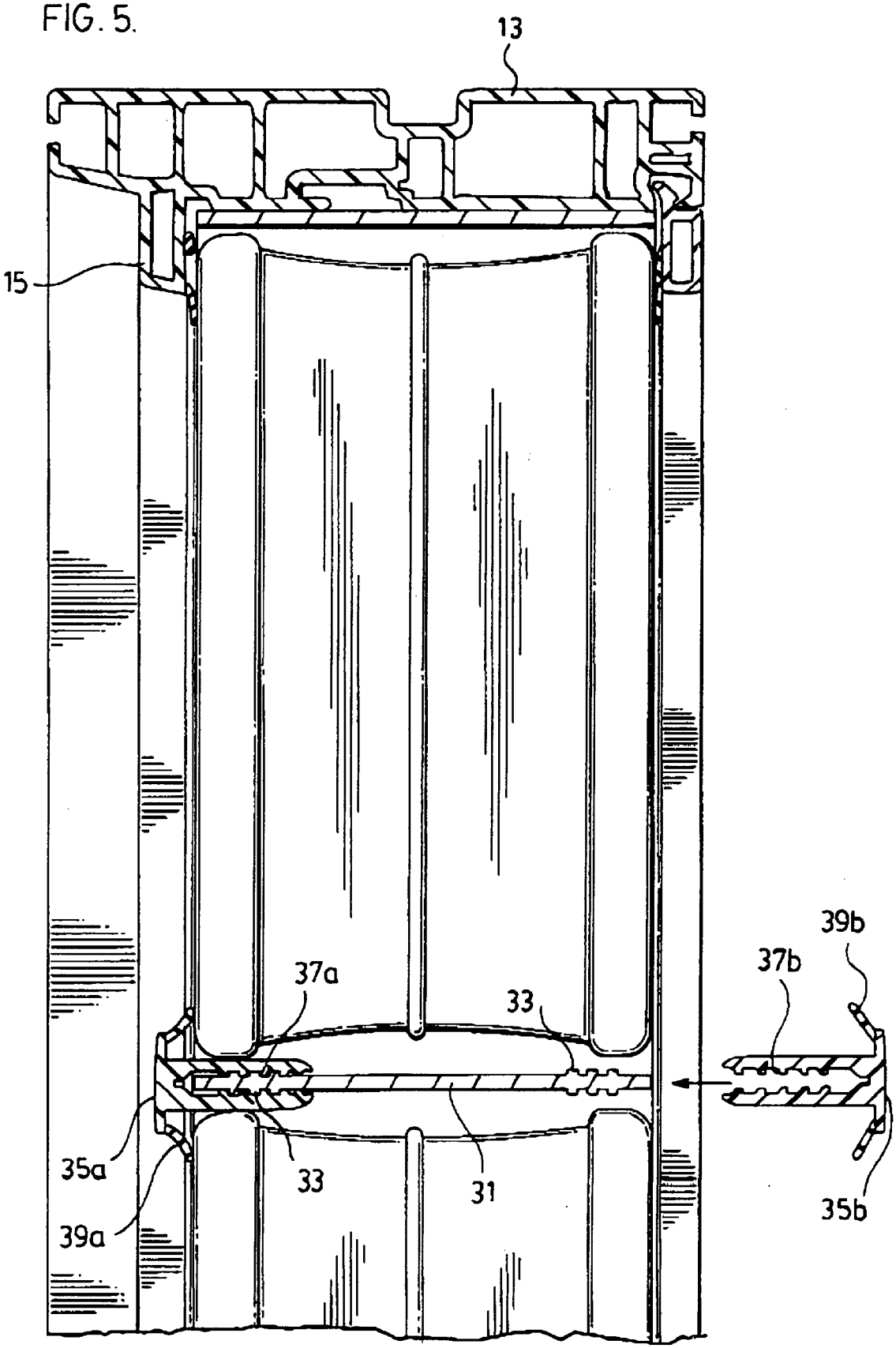

The interior frame 27 which as described above is made from a rigid light weight material such as aluminum and the like is formed with an outer wall 29 bordering a plurality of grid forming frame members 31 as will be best seen in FIG. 5 of the drawings. Each of the frame members 31 is provided to its opposite ends with a notched region 33.

In the initial assembly of panel 11 the peripheral frame 13 is placed on a support surface with glazing bead 15 located at the bottom side of the peripheral frame. Glazing bead 15 presents an inwardly directed lip which then receives the outer wall 29 of the interior frame. However before fitting the interior with the peripheral frame, retainers 35*a* having a T shape are fitted to one side of each of the frame members 31. The retainers 35*a* like the peripheral frame have a plastic and again preferably vinyl construction. Each of the T shaped retainers 35*a* includes a hollow interiorly notched tongue 37*a* which pushes onto the notched region 33 of the frame member 31. These retainers, once locked in position will not release and therefore cooperate with the integral bead 15 to prevent outward pulling of the glass blocks.

When the interior frame is lowered onto the glazing bead 15 of the peripheral frame 13 the retainers 35*a* on the interior frame are level with the glazing bead 15. The overall frame as assembled to this point is now prepared to receive the glass blocks which are simply dropped into the pockets formed by the cooperation between the exterior and interior frames. The retainers 35*a* provide a lip around part of the pocket while the glazing bead 15 provides a lip around the rest of the pocket to form a support surface for each glass block. In the interior pockets away from the peripheral frame all of the retaining lip is provided by the retainers.

After all of the glass blocks have been laid into position the assembly of the frame is completed by securing further T shaped retainers 35*b* onto the other notched end region 33 of each of the frame members 31. Retainers 35*b* like retainers 35*a* have the plastic and preferably vinyl construction with a hollow notched tongue 37*b* and coextruded flexible seals 39*b*.

To finalize securing of the glass blocks glazing beads 19 are locked onto the peripheral frame 13 through the cooperation of a locking tongue 21 on the bead 19 and a tongue receiving slot 25 on the peripheral frame. In the assembled construction the glass blocks apply outward pressure on the glazing bead to provide a very positive interlock of the tongue in the slot.

The glazing beads 19 like the retainers and the peripheral frame are again formed from a plastic and preferably vinyl material. They are coextruded with seals 23. These seals in cooperation with the seals 39*b* of the retainers 35*b* assure a fixedly held, sealed fitting of the glass blocks on one side of the panel while the seal 17 of the integral glazing bead 15 cooperates with the seals 39*a* on the retainers 35*a* to hold and seal the glass blocks on the other side of the panel. Accordingly no further sealing in the form of caulking, mortaring or the like is required for the glass blocks. They are effectively equally spaced, sealed and locked in place strictly by the vinyl material of the frame components around them.

Figure 5A:
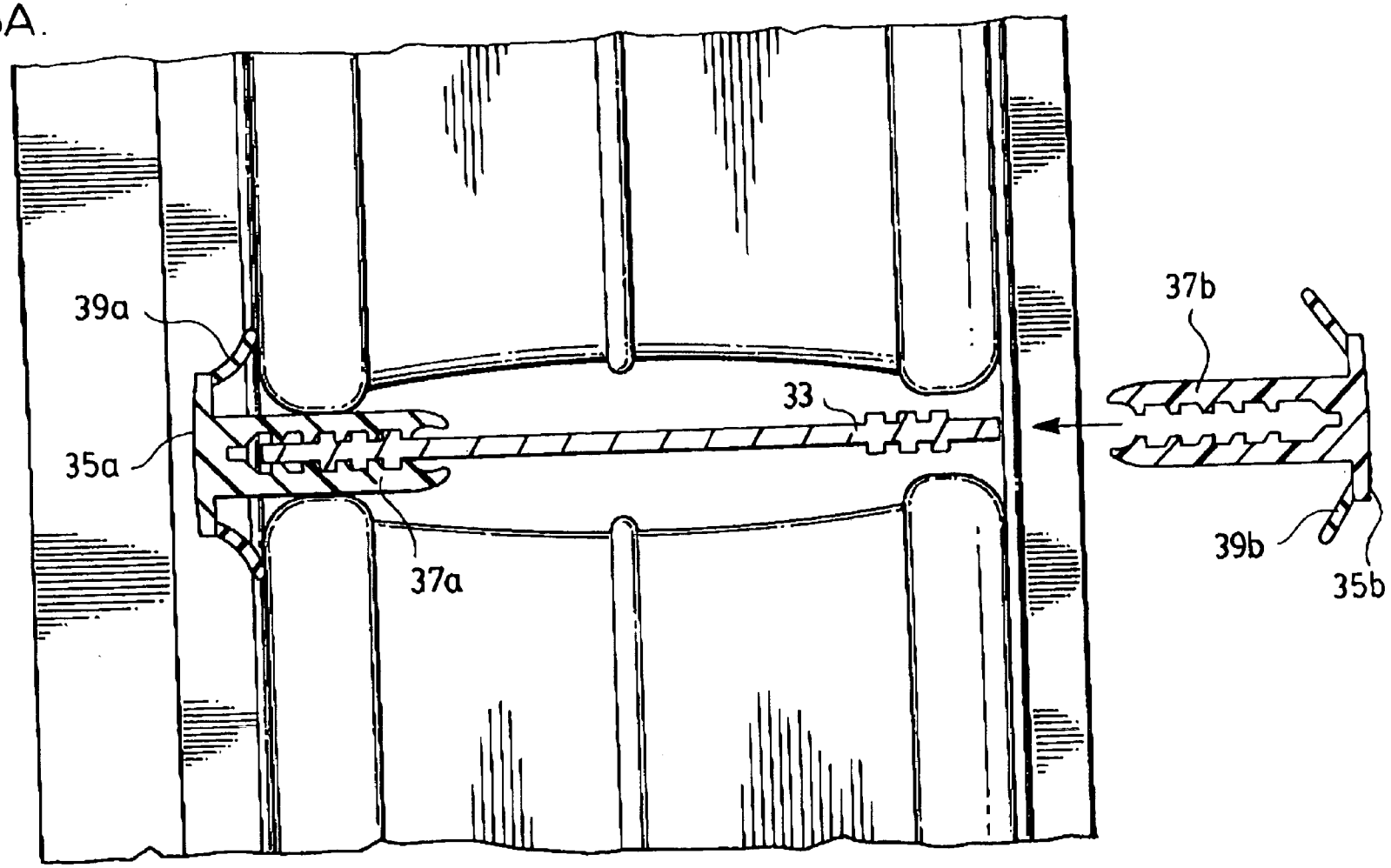

FIG. 5A shows that there is a small difference between retainers 35*a* and 35*b*. Although both are made of a plastic material and both have coextruded seals, their notched inner surfaces do differ from one another. In particular the notches to the inside of the tongue 37*a* of retainer 35*a* are substantially squared off providing a very positive interlock with the correspondingly squared notches 33 of the frame members. Therefore once fitted in position, retainers 35*a* are essentially, non releasable from the interior frame so that they cooperate with the integral bead 15 in preventing the blocks from being pulled outwardly of the panel as earlier described.

Retainers 35*b* on the other hand have much more rounded notches internally of the tongues 37*b*. This rounding of the notches while providing more than adequate support for holding the glass blocks in place, does allow the retainers 35*b* to be pulled under sufficient force from the interior frame, which in turn allows replacement of the glass blocks should this be needed or desired.

Also the glazing beads 19 while being positively interlocked with the rest of the peripheral frame, can be released to replace the interior frame if desired.

As will be appreciated from the description above all external surfaces of the two piece frame are either covered or formed by the plastic material which provides both pleasing appearance and effective heat insulation and weatherproofing qualities to the frame. The interior aluminum frame which provides the required rigidity for holding the glass blocks in place is completely hidden from the outside of the frame.

One of the prime benefits provided by the simple yet efficient construction of the two piece frame described above is that it is easily assembled at the job site. This means that the glass blocks which are of a substantial weight do not need to be handled on mass but rather can be carried individually or at least in small groups to the location where they are to be used.

In addition, assembly of a glass block panel of the present invention requires no special skills thus making it both easy and affordable for virtually any homeowner to put the panel together. Also the frame can be fitted in a wall or the like at one time and then the glass blocks can later be added which, among other things, allows different stages of assembly by different people if desired.

A further feature of the invention is that the panel can be dismantled by removing the releasable glazing bead and retainers from the one side of the frame. This allows for replacement of the glass blocks and even the interior frame should this be desired.

Figure 6:
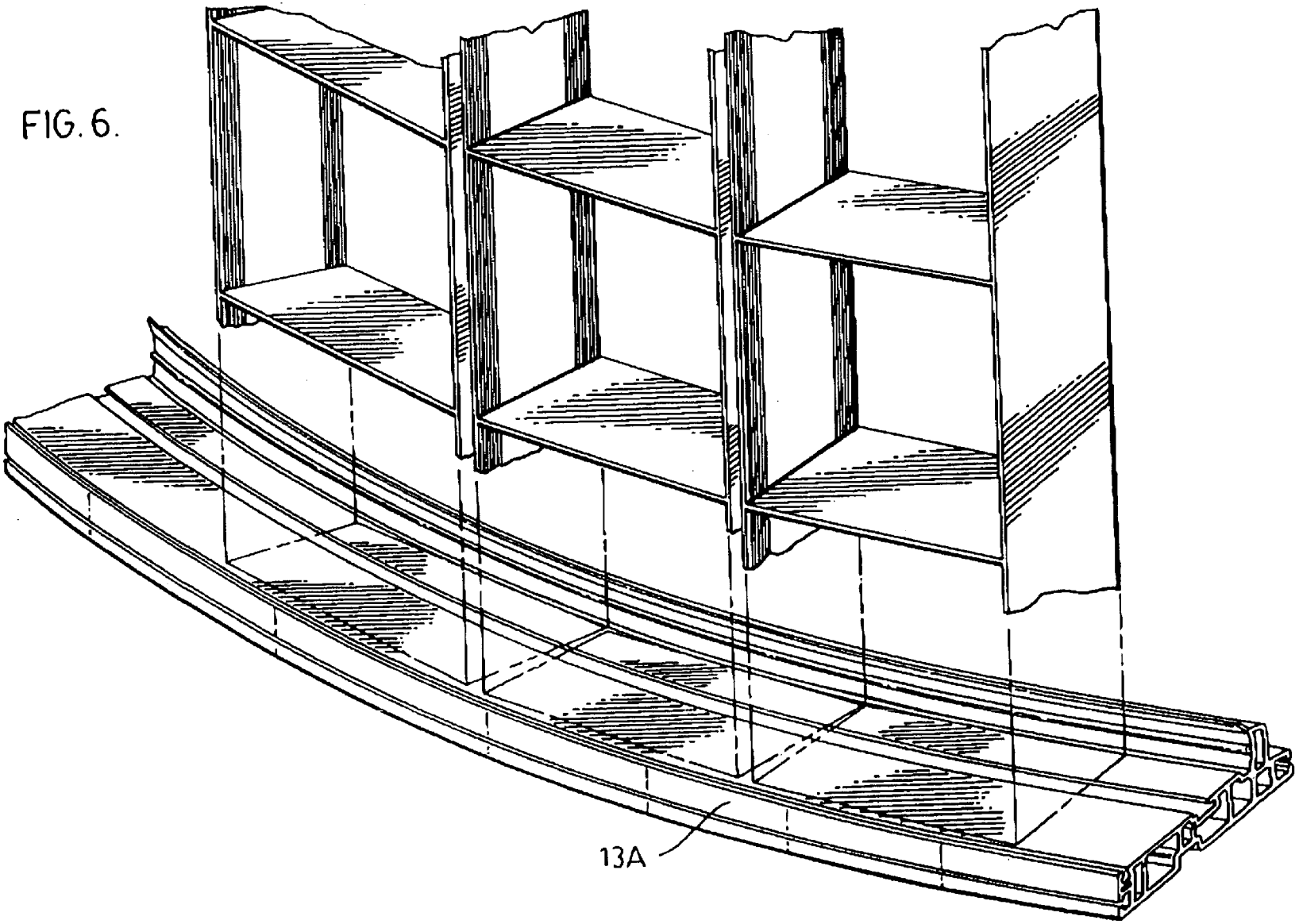
FIG. 6 shows a partially assembled glass block construction kit according to a further preferred embodiment of the present invention.
Figure 7:
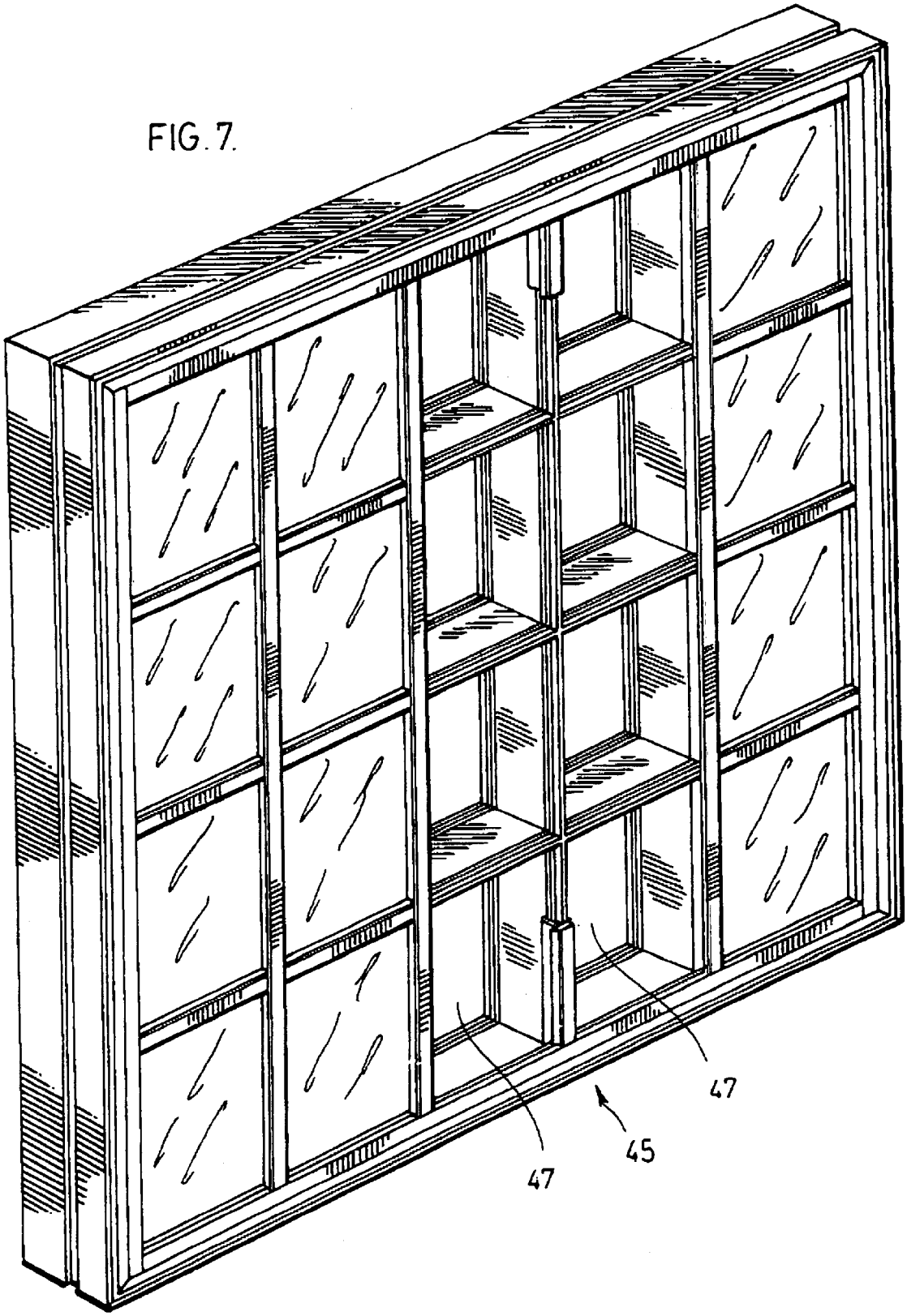
FIG. 7 is a perspective view of a glass block panel using a construction kit according to still a further embodiment of the present invention.
Figure 8:
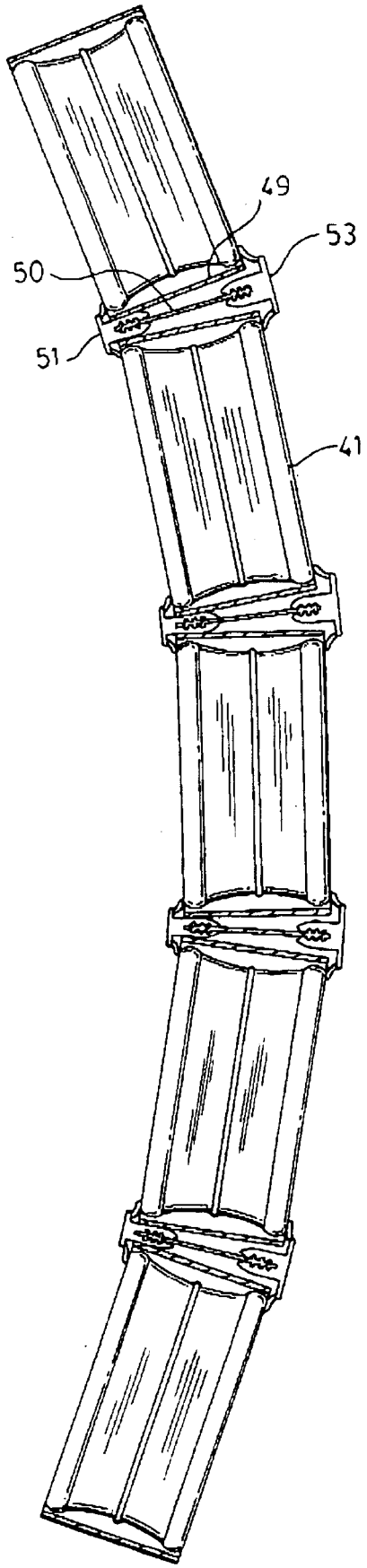
FIG. 8 is a top view of a series of glass blocks secured in a bowed formation within a panel using a construction kit according to a further preferred embodiment of the present invention.

Some additional assemblies of a glass block panel according to further preferred embodiments of the invention are shown in FIGS. 6, 7 and 8 of the drawings. More particularly FIG. 6 shows that the outer peripheral frame need not be formed with straight walls but rather may include a curved frame 13*a* as well as other additional non flat configurations.

FIG. 7 shows a glass block panel generally indicated at 45 where a number of the pockets 47 within the grid are not filled in with glass blocks. This allows direct viewing and ventilation through these particular pockets while the pockets around them which are occupied by the glass blocks do not allow direct viewing. These pockets can later be filled with glass blocks if the ventilation and viewing becomes undesirable.

FIG. 8 shows a very interesting arrangement in which the same glass blocks 41 are held in a window panel in bowed configuration. This is accomplished by placing tapered spacers 49 between each of the blocks 41. Each of these spacers includes a center bar 50 which is notched at its opposite ends exposed to either side of the spacer 49. T members 51 and 53 having a hollow notched tongue are then slid onto the notched regions of the center bar 50 of the spacer 49.

Spacer 49 is once again made from a rigid, preferably aluminum material while the T members are made from a plastic, preferably vinyl material. Each of the T members has a coextruded resilient seal with the T members 51 to the inside of the bow having a substantially shorter head than the T member 53 to the outside of the bow. The T members when engaged by the center bar 50 of the spacer apply sufficient pressure on the glass blocks 41 to hold them in their bowed configuration.

Figure 9:
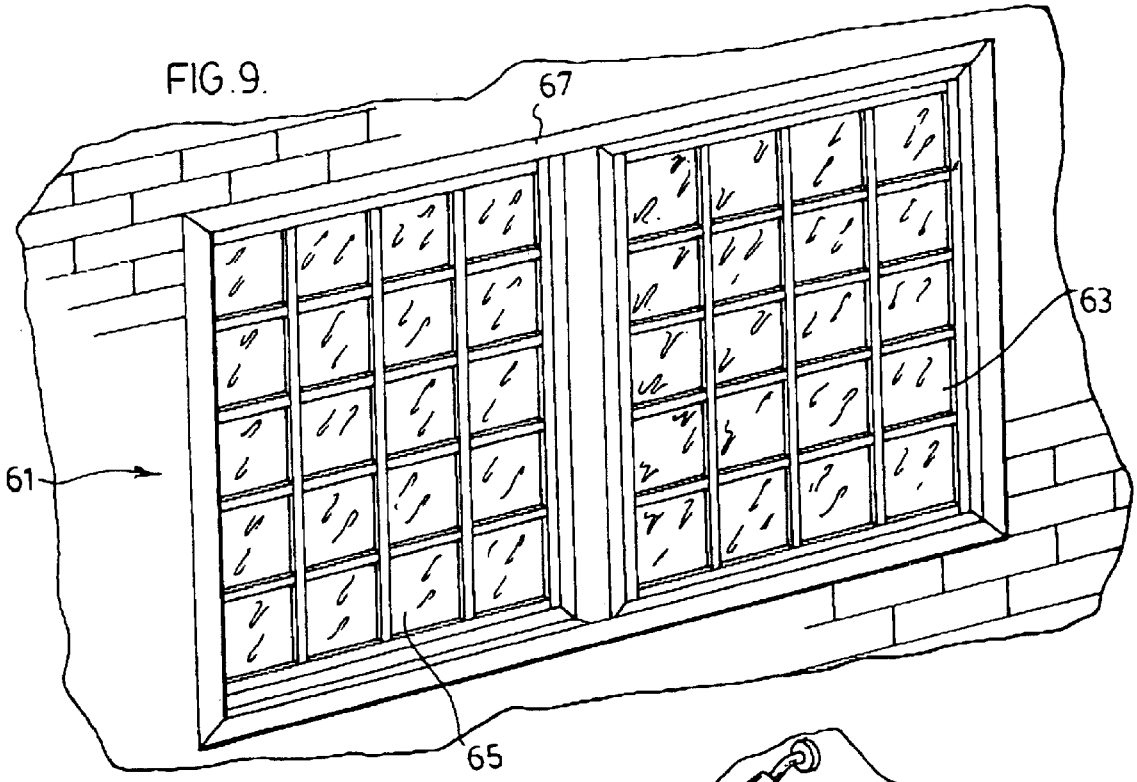
FIG. 9 is a perspective view of a sliding window formed from glass block panels using construction kits according to a further preferred embodiment of the present invention.
Figure 10:
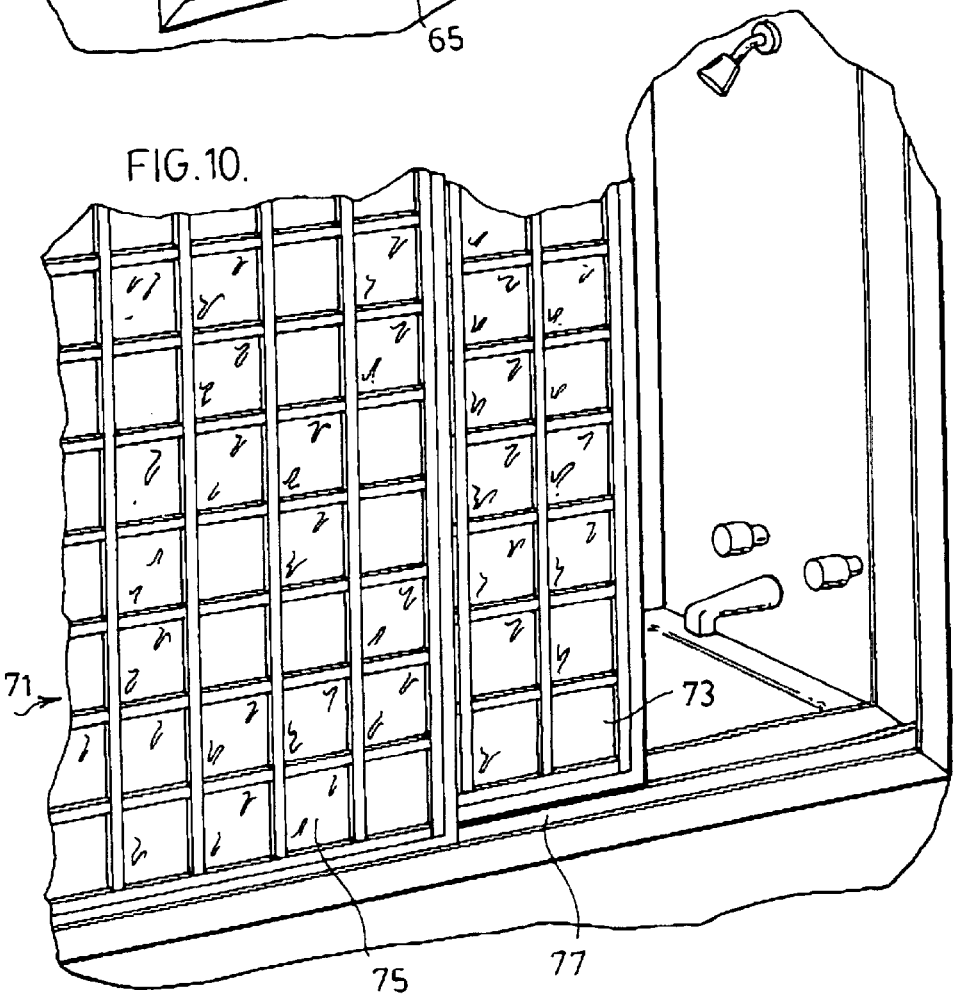
FIG. 10 is a perspective view of a shower door formed from a glass block panel using a construction kit according to still a further preferred embodiment of the present invention.
Figure 11:
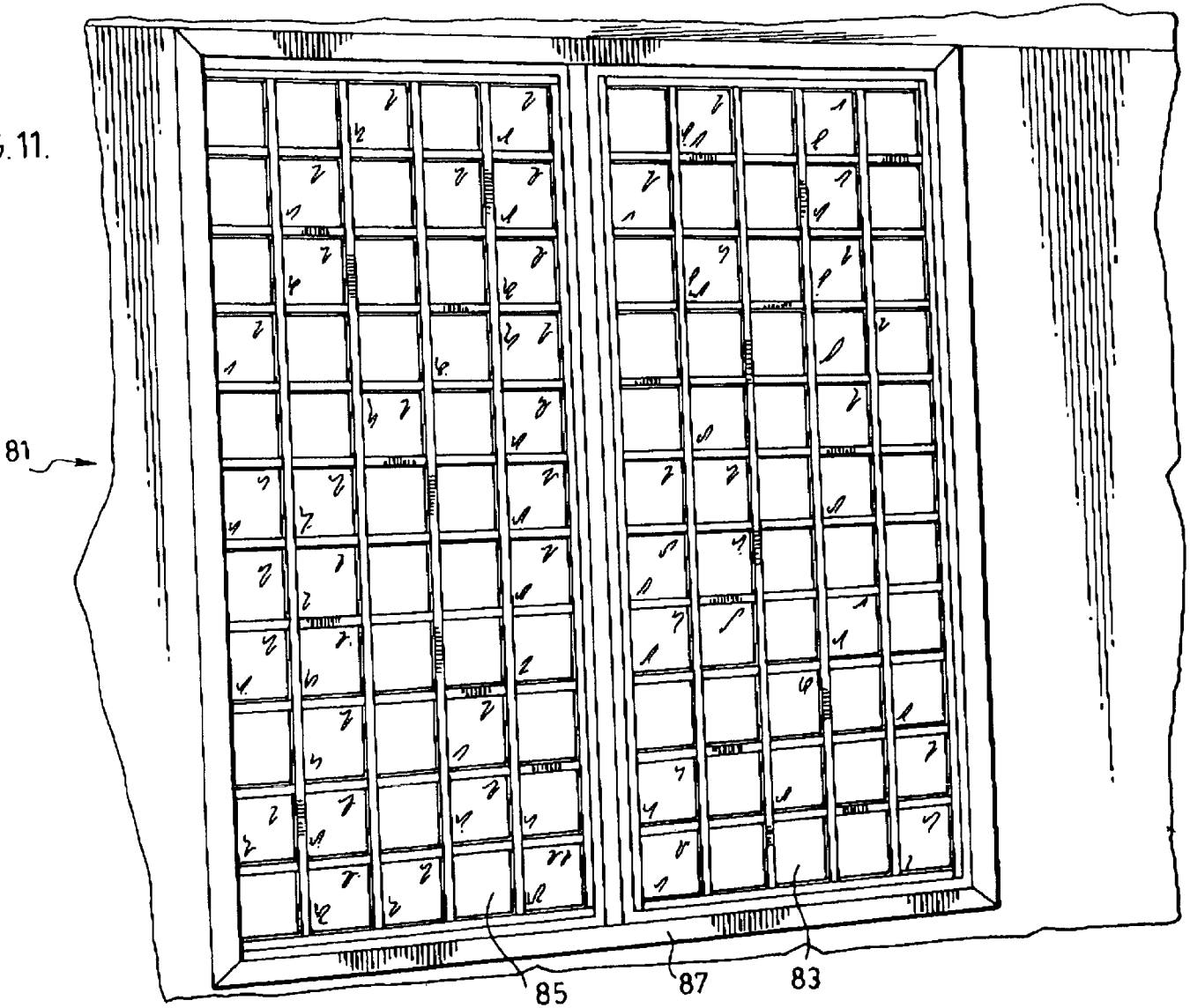
FIG. 11 shows a patio door made from glass block panels using construction kits according to another preferred embodiment of the present invention.

The description above shows the use of glass block panels in a stationary position. FIGS. 9 through 11 on the other hand show that these glass block panels can be used in a sliding window or door arrangement.

More particularly FIG. 9 shows a horizontally sliding window generally indicated at 61. This window is formed by a pair of glass block panels 63 and 65 which are the same construction as those described above with either one or both of the panels being slideably held within a surrounding frame 67. Frame 67 preferably has a vinyl construction.

In FIG. 10*a* shower door assembly is generally indicated at 71. This assembly comprises a pair of glass block panels 73 and 75 which again have the same construction as the earlier described panel assemblies. Either or both of the panels 75 and 73 are slideably secured within a surrounding door frame 77.

FIG. 11 shows a patio door formed by glass block panels 83 and 85 with either or both of the glass block panels being slideable within the surrounding frame 87.

Figure 12:
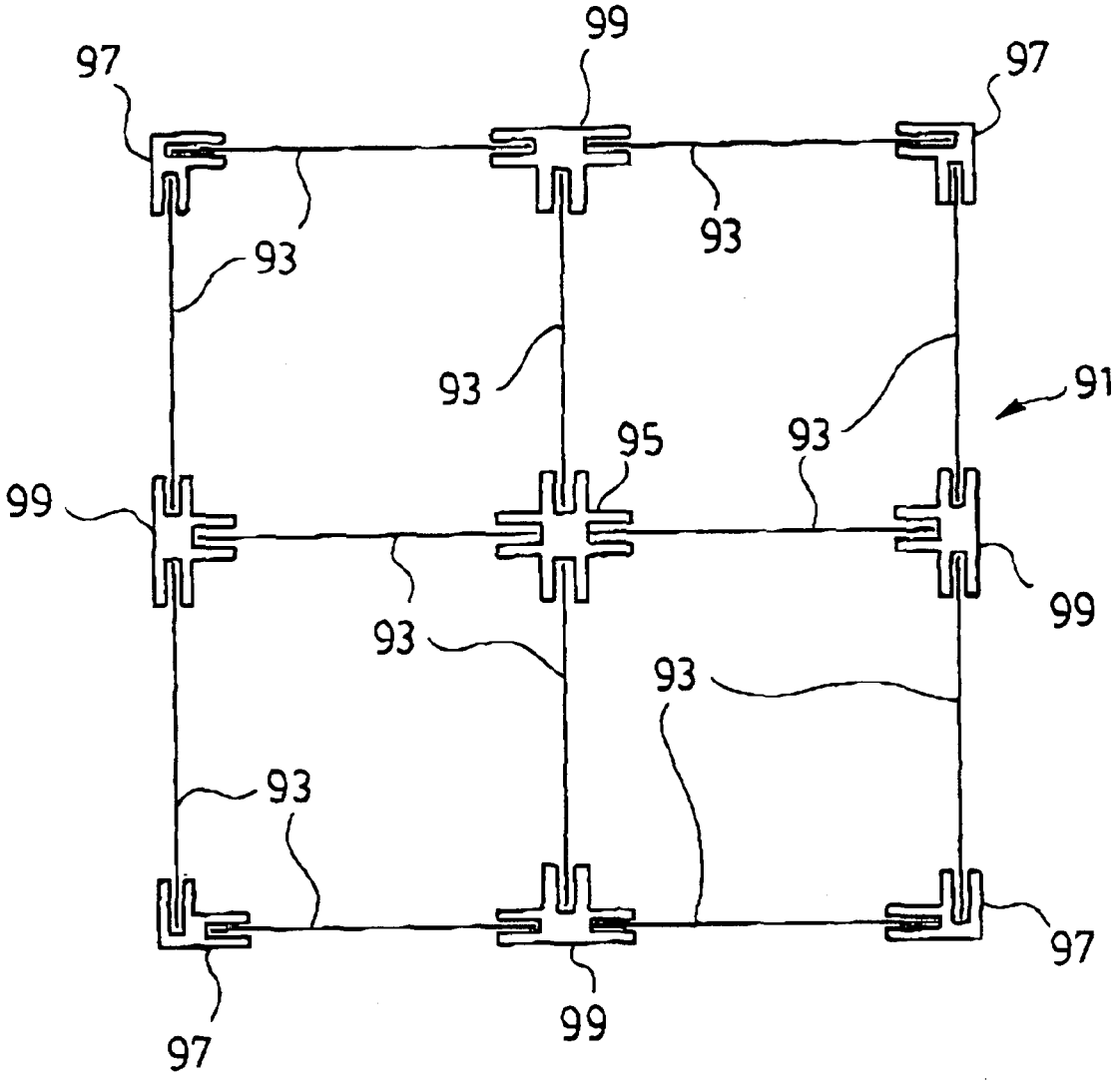
FIG. 12 is a side view of an interior frame for fitting with a peripheral frame in forming a glass block construction kit according to still another preferred embodiment of the present invention.

FIG. 12 shows a novel construction for an interior frame 91 which can be used in replacement of the interior frame 27 shown in FIG. 2 of the drawings. Interior frame 91 is formed from a plurality of rigid and preferably aluminum frame members 93 which rather than being welded to one another are secured by intervening non metallic connectors. The connectors which are preferably made from a vinyl material include a center connector 95 having four tongues, corner connectors 97 having two tongues and mid wall connectors 99 having three tongues. The tongues on the connectors are all notched as are the opposite ends of the frame members 93 to provide a positive securing of the frame members to one another through the different connectors.

When using the construction shown in FIG. 12 of the drawings, the interior frame has a thermal break provided by the non conductive connectors at each end of the frame members. However the bulk of the interior frame still has its aluminum construction and is therefore sufficiently rigid to hold the glass blocks in place.

Although various preferred embodiments of the present invention have been described herein in detail, it will be appreciated by those skilled in the art, that variations may be made without departing from the spirit of the invention or the scope of the appended claims.

The embodiments of the invention in which an exclusive property or privilege is claimed are defined as follows:

1. A construction kit which assembles to form a glass block panel comprising a peripheral border of plastic material with inwardly directed lips on opposite sides thereof, an interior frame of material more rigid than that of said peripheral border, said interior frame having an outer wall held by the lips on said peripheral border and also having a plurality of grid forming frame members bordered by said outer wall and forming glass block pockets within said panel and plastic glass block retainers mounted on both sides of each frame member, the inwardly directed lips of said peripheral border in combination with the glass block retainers providing a plastic outer frame which both holds said glass blocks in and covers said interior frame to both sides of said panel.

2. A construction kit as claimed in claim 1 wherein the lip on the peripheral border at one side of the panel is removably secured for insertion and removal of said interior frame and the retainers on said one side of said panel are removably secured to the frame members for insertion and removal of glass blocks within said panel.

3. A construction kit as claimed in claim 1 wherein said retainers have a T shape with a frame member securing stem.

4. A construction kit as claimed in claim 1 wherein said interior frame is made of aluminum.

5. A construction kit as claimed in claim 1 wherein said frame members are made of aluminum and are secured to one another by plastic connectors.

6. A construction kit as claimed in claim 1 wherein the lips on said peripheral border and said retainers all include integrally formed flexible seals.

7. A construction kit as claimed in claim 2 wherein the lip on the opposite side of the peripheral border from the removable lip is integrally formed with said peripheral frame.

8. A method of forming a glass block panel assembly comprising providing a peripheral frame of plastic material with a first inwardly directed lip on one side thereof, placing a more rigid interior frame having an outer wall and grid forming frame members bearing first plastic retainers on one side thereof on said first lip, the first retainers being substantially level with the first lip, the frame members forming pockets, inserting glass blocks within the pockets supported on one side by said first retainers fitting second plastic retainers on the other side of said frame members to trap the glass blocks in said pockets, and fitting a second inwardly directed plastic lip on the other side of the peripheral frame to trap said interior frame within said assembly.

9. A method as claimed in claim 8 wherein said second plastic retainers and said second lip are removably fitted to said panel assembly.

10. A construction kit which assembles to form a glass block panel comprising a plurality of glass blocks, a peripheral border of plastic material with inwardly directed lips on opposite sides thereof, an interior frame of material more rigid than that of said peripheral border, said interior frame having an outer wall held by the lips on said peripheral border and also having a plurality of grid forming frame members bordered by said outer wall and forming glass block pockets within said panel, and plastic glass block retainers mounted on both sides of each frame member, the inwardly directed lips of said peripheral border in combination with the glass block retainers providing a plastic outer frame which holds said glass blocks in said interior frame and which provides a seal for each of said glass blocks to either side of said panel, said plastic outer frame covering said interior frame to both sides of said panel.

* * * * *